United States Patent [19]

Rado et al.

[11] 4,004,562

[45] Jan. 25, 1977

[54] MULTIPLE AIR GAP SPARK PLUG HAVING RESISTIVE ELECTRODE COUPLING

[75] Inventors: William G. Rado; Allen H. Turner, both of Ann Arbor, Mich.

[73] Assignee: Ford Motor Company, Dearborn, Mich.

[22] Filed: Dec. 26, 1974

[21] Appl. No.: 536,665

[52] U.S. Cl. ..... 123/169 MG; 123/169 EL; 313/140; 313/142; 315/58

[51] Int. Cl.[2] ..... H01T 13/20

[58] Field of Search ..... 123/169 MG, 169 EL, 123/143 R, 143 B; 313/123, 128, 140, 141, 142; 315/58

[56] References Cited

UNITED STATES PATENTS

| | | | |
|---|---|---|---|
| 1,253,587 | 1/1918 | Graham | 313/123 X |
| 1,381,167 | 6/1921 | De Clairmont | 313/140 X |
| 3,394,285 | 7/1968 | Lindsay | 313/140 X |
| 3,488,556 | 1/1970 | Burley | 313/140 X |
| 3,567,987 | 3/1971 | Schnurmacher | 313/141 X |
| 3,921,020 | 11/1975 | Wax | 123/169 EL X |
| 3,956,664 | 5/1976 | Rado et al. | 313/140 X |

*Primary Examiner*—Charles J. Myhre
*Assistant Examiner*—Tony M. Argenbright
*Attorney, Agent, or Firm*—Robert A. Benziger; Keith L. Zerschling

[57] ABSTRACT

A spark plug having multiple air gaps is described. The multiple gaps are defined by at least three electrode members defining at least two air gaps. A first electrode member is communicated to a ground potential while a second electrode member, the electrode member which is maximally spaced apart from the first electrode member, is communicated to a source of high voltage potential. The remaining electrode members are positioned intermediate the first and second electrode members and are arranged to be coupled by high resistance electrical means to either the ground or the high voltage potential. In a preferred embodiment, the high resistance means comprise a ladder type resistance network embedded within the ceramic body of the spark plug and electrically interconnecting the intermediate electrode members and the electrical connecting cap of the spark plug device. The air gaps so formed are broken down in sequence and share in the dissipation of the stored energy. The electrodes are arranged so that the air gaps extend away from the spark generating device.

8 Claims, 3 Drawing Figures

MULTIPLE AIR GAP SPARK PLUG HAVING RESISTIVE ELECTRODE COUPLING

CROSS-REFERENCE TO RELATED APPLICATION

This invention is related to, and is an improvement of, the invention described and claimed in copending, commonly assigned patent application Ser. No. 536,664 filed Dec. 26, 1974, now abandoned, in the name of George W. Pratt, Jr. and titled "Multiple Air Gap Spark Plug".

BACKGROUND OF THE INVENTION

Field of the Invention

The present invention is directed to the field of spark generating devices. More particularly, the present invention is directed to that portion of the above-noted field which is concerned with the generation of an electrical spark for purposes of ignition of an air/fuel mixture. More particularly still, the present invention is directed to that portion of the above-noted field which is concerned with devices for generating a spark for igniting the air/fuel mixture in an automotive internal combustion engine. More particularly still, the present invention is directed to that portion of the above-noted field which is concerned with the generation of sparks capable of igniting air/fuel mixtures having excess quantities of air or which have been diluted by the inclusion of combustion byproducts (hereinafter collectively referred to as "lean mixtures"). More particularly still, the present invention is directed to that portion of the above-noted field which is concerned with the generation of sparks for igniting lean mixtures while avoiding the necessity of generating voltage potentials higher than those presently utilized. The present invention is also concerned with devices for generating an ignition spark having an increased spark length without requiring an increase in the voltage applied to the spark generating device. More particularly still, the present invention is directed to that portion of the above-noted field which is concerned with the manufacture of such spark plug devices.

DESCRIPTION OF THE PRIOR ART

The above-noted patent application describes a spark plug device having a plurality of electrodes arranged to define a plurality of spark generating air gaps. In order to lengthen the overall spark length without requiring a substantial increase in the energizing voltage, the intermediate electrodes of the spark plug according to the above-noted patent application are coupled to a stable voltage reference, either ground or the high voltage input signal, by high impedance coupling. As illustrated and described in the above-noted patent application, this high impedance coupling is achieved through capacitive coupling between the intermediate electrode members and the grounded spark plug housing. While this arrangement has produced excellent results, a problem has arisen with respect to manufacturing such a device in large quantities.

In order to achieve the necessary relationship in the impedance of the electrode coupling and the impedance of the spark gaps associated with the electrode, it is necessary that the capacitive coupling be on the order of at least two magnitudes larger than the capacitance of the spark gap. In those spark plugs which illustrate the capacitance to be provided by capacitive coupling between one or more plate members embedded within the spark plug ceramic body and the grounded spark plug housing, it is necessary that the embedded plate members be relatively large in area or be provided with special dielectric material in order to achieve the desired high level of capacitance. Where more than one intermediate electrode is provided, this necessitates that the spark plug housing be enlarged to provide for sufficient area of spark plug housing so that the capacitive plates may be situated within the ceramic body of the spark plug with a minimum of cross coupling between the embedded plate members. Furthermore, since the spark plugs generally in use in internal combustion engines are of cylindrical design, the embedded plate members must be cylindrical or at least a curved section of a cylinder. In automated manufacture of spark plug devices, the placement of the capacitor plate members within the ceramic is anticipated to be very difficult to maintain at a uniformly proper spacing with respect to the axis of the cylinder of the spark plug. It will be appreciated that any nonuniformity in spacing will seriously alter the level of capacitive coupling and may defeat the general objectives of the high impedance coupling arrangement.

It is therefore an object of the present invention to provide a spark plug device having a plurality of electrodes arranged to define a plurality of spark generating air gaps wherein intermediate electrode members may be provided with high impedance coupling to a stable voltage reference in such a fashion that the spark plugs may be readily manufactured. By "stable voltage reference" is meant an electrical circuit member or component having a voltage level which is relatively unchanging with respect to the applied or energizing voltage during the time of generation of a spark. More particularly still, it is an object of the present invention to provide such a spark plug device wherein the physical dimensions of the spark plug do not include any highly critical dimensions. More particularly still, it is an object of the present invention to provide such a device wherein the tolerances associated with the embedded high impedance coupling means are sufficiently large so that the resulting spark plugs may be economically manufactured. More particularly still, it is an object of the present invention to provide such a spark plug device whose manufacturing cost need not be prohibitively great.

SUMMARY OF THE PRESENT INVENTION

We have determined that a multiple air gap spark plug device may be provided with resistive high impedance coupling of the intermediate electrode members with a stable voltage reference in a fashion which may be readily manufactured in a more economical manner than the capacitive high impedance coupling described in the above-noted copending commonly assigned patent application. By providing one or more resistor bodies embedded within the ceramic body of the spark plug and electrically connected to individual ones of the intermediate electrodes and, for example, the spark plug electric connector cap, the intermediate electrodes will be electrically connected to a stable voltage reference with sufficiently high impedance that minor, to insignificant, amounts of the applied electrical energy will be dissipated across the high impedance resistors while each of the spark generating air gaps are sequentially broken down. This arrangement provides for an overall spark length which is greatly increased with respect to single air gap spark plugs. Furthermore, the high impedance resistive means may be easily situated within the green ceramic material which, after firing, will form the ceramic body of the spark plug in such a fashion as to permit dimensional values having relatively large numerical tolerances consistant with automatic spark plug manufacture.

DETAILED DESCRIPTION OF THE PREFERRED EMBODIMENT

Figure 1:
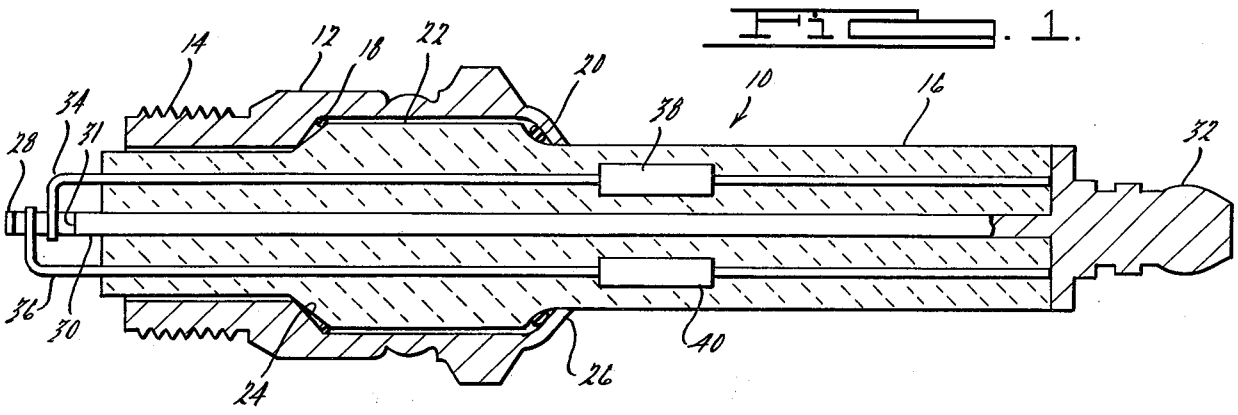
FIG. 1 is a sectional view of a spark plug device fabricated to incorporate the present invention.
Figure 2:
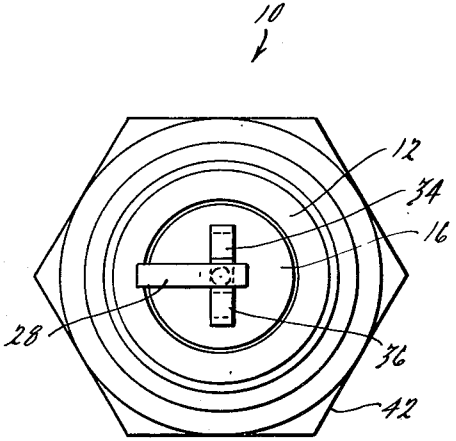
FIG. 2 is an elevational end view of the spark plug device of FIG. 1 illustrating the positional relationship of the various spark plug device electrodes.

Referring now to the drawing, wherein like numbers designate like structure throughout the various views thereof, a spark generating device 10 for ignition of an air/fuel mixture combustion charge in a combustion chamber of an internal combustion engine is shown in FIGS. 1 and 2. Spark generating device 10 includes conductive, preferably metallic, housing structure 12 which is threaded on one end, as at 14, for receipt within a suitably threaded port in an internal combustion engine combustion chamber. Since such engines and spark plug usages are norotiously well known, it is believed that illustration of such engines is not necessary to an understanding of my invention. A ceramic dielectric material insulating member 16 is received within housing portion 12. Seal means 18, 20 are arranged on opposite sides of shoulder portion 22 of the ceramic dielectric material 16. Seal means 18 cooperates with shoulder portion 24 of the housing member 12 while seal means 20 cooperates with a shoulder portion 26 of housing member 12 to rigidly retain insulating member 16 within housing 12 in fluid tight fashion.

Ground electrode 28 is connected to housing 12 and is arranged to extend away from the threaded end portion 14 of housing 12. High voltage electrode 30 extends through the central body portion of the insulating member 16 and terminates in a metallic cap portion 32. Cap portion 32 is adapted for connection to the electrical ignition system not shown of an internal combustion engine. Since ignition systems for inter internal combustion engines are notoriously well known, illustration of a representative ignition system is believed to be unnecessary. As is normally the practice, insulating member 16 is formed of a ceramic dielectric material and is generally cylindrical in form. The high voltage electrode 30 extends along the axis thereof and terminates in sparking surface 31 at the end opposite cap portion 32. Ground electrode 28 is configured to place a sparking portion in an axially confronting relationship to the sparking surface 31 of high voltage electrode 30. As thus described, spark generating device 10 comprises a substantially conventional spark plug device intended for use in igniting the combustible air/fuel charge in an internal combustion engine. The axial spacing between the confronting portion of electrode 28 and electrode 30 comprises an air gap in which electrical sparking will occur when a sufficiently large potential is applied between metallic cap 32 and housing portion 12 by a conventional ignition system. The physical length of the air gap is a function of the electrical potential applied across housing port 12 and metallic cap 32. The ignition system of the internal combustion engine may be arranged to maintain housing portion 12 either negative, or positive, with respect to the potential applied to metallic cap 32.

According to the present invention, a pair of intermediate electrodes 34, 36 are arranged to extend from the insulating member 16 and are positioned to be within the air gap defined by the confronting portions of electrode members 28 and 30. Intermediate electrode members 34, 36 are arranged to divide the air gap between the confronting portions of electrode members 28, 30 into three air gaps. These gaps may be arranged to be substantially equal in length and equal to the maximum gap which may be broken down by the selected energizing voltage as will become clear from the description which follows. Each intermediate electrode member 34, 36 is provided with high resistance electrical means intercommunicating the associated intermediate electrode member 34, 36 with an electrical circuit location at a substantially constant electric potential. In the illustrated embodiment, this substantially constant electric potential is the high voltage potential established for the spark plug device 10 by the associated electrical ignition system. The high resistance coupling is achieved by connecting the intermediate electrodes 34, 36 with resistors 38, 40 embedded within insulator 16 and connecting the resistors 38, 40 to the cap 32 to form a ladder-type resistance network.

Referring now to FIG. 2, an end view of a spark plug member 10 fabricated to incorporate the present invention illustrates the interrelationship of the various electrode members. The high voltage potential electrode 30 is illustrated by a phantom line as lying at the approximate axial center line of the generally cylindrical insulating member 16. The intermediate electrode members 34, 36 are shown as overlapping the central electrode member 30 and each other. Ground electrode member 28 is shown to be connected to housing portion 12 and to overlap the other electrode members. As illustrated in this embodiment, housing portion 12 is provided with a hexagonal wrench gripping portion 42 in the conventional manner. As can be seen from a consideration of FIGS. 1 and 2, the electrode members 28, 30 and 34, 36 are arranged to be spatially separated, one from the other, and to define a plurality of spark air gaps which are aligned substantially along the axis of insulating member 16. The spark forming air gaps thus formed are substantially continuous in a linear direction being interrupted only by the intermediate electrodes. Depending on combustion charge distribution, the air gaps could also be arranged to deviate from the center line of the spark plug 10. It will be appreciated that the actual placement of the spark gaps defined by the various electrodes is not critical to the present invention but that illustrated arrangement will enable a generated spark to penetrate deeper into a combustion charge. In the instance of a lean mixture combustion charge, the larger total spark length and deeper penetration will assure ignition of the combustion charge.

Figure 3:
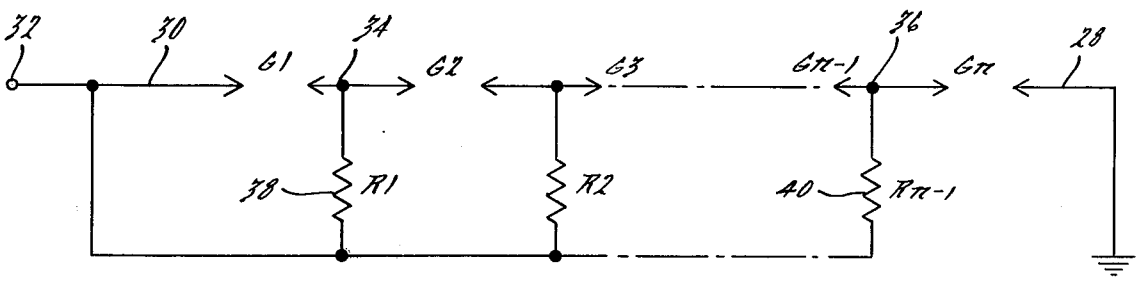
FIG. 3 is a circuit diagram illustrating the operation of the present invention.

Referring now to FIG. 3, a circuit illustrative of the operation of the present invention is shown. The various spark plug electrodes 28, 30, 34 and 36 are illustrated as being the circuit junctions on either side of the spark gaps identified as G1, G2 and GN. The intermediate electrodes 34, 36 are shown as being resistively connected to the central electrode and cap 32 by resistances identified as R1, and R2. FIG. 3 also illustrates further spark gaps identified as G3 through GN-1 having electrodes which are coupled to the stable voltage source through resistance identified as RN-1. In each instance, the resistance value of the resistances R1, R2 and RN-1 is selected to be very much larger than the resistance of arc produced in the associated gaps G1, G2, G3, GN-1 and GN.

In operation, a high voltage pulse would be applied to cap terminal 32 and to electrode 30 by an ignition system, not shown. This high voltage pulse could be generated by any of the known ignition systems in the conventional manner and may be at the level of energization normally utilized in automotive vehicle ignition systems. Each intermediate electrode 34, 36 would, at that point in time, be brought to substantially the same high voltage potential through the resistive network since there would be no current flowing until the first gap breaks down. The presence of a large voltage signal on electrode 36 would operate to produce a large voltage differential across air gap GN to thereby break down the air gap GN and create a spark discharge. The voltage appearing on electrode 36 would thereafter drop to a value very close to the ground potential compared to the potential applied to the cap terminal 32. The spark across air gap GN would be maintained by current flow through the ionized gap and little energy would be dissipated because of the high resistance of the then series connected resistor RN-1. The breakdown of air gap GN-1 will occur as a result of the potential on electrode 36 going very close to the ground potential while the potential appearing on the adjacent electrode remains high. This sequence would continue until electrode 34 was approaching the ground potential as a result of the breakdown of gap G2. The energizing voltage applied to electrode 30 will cause gap G1 to break down and all gaps would remain broken down until current flow ceases.

Once a gap breaks down, the resulting current flow causes little voltage to drop across the gap. Thus, each of the gaps G1, G2, GN-1 and GN is subjected to substantially the full energizing potential immediately prior to its breakdown. As a consequence, the length of each gap may be made substantially the same and substantially equal to the length of the gap of a single gap plug operated under the same conditions. This results in a total potential spark gap length which is several multiples of the spark length which the prior art devices could achieve at the same level of electrical energization. While slight amounts of energy are dissipated at each of the gaps, the voltage drop is slight compared with the energizing voltage as long as a resistance R1, R2, RN-1 is in series with the gaps. The maximum value of resistance should not be so large that the resistances 38, 40 begin to behave as capacitors. Under such circumstances the capacitance of the gap will be sufficiently large compared to the capacitance of the resistance 38, 40 that capacitive voltage division will result to the detriment of the performance of the spark plug device. By way of example, we have compared multiple gap spark plugs having varying levels of resistance coupling with a conventional (single-gap) spark plug. In order to determine a useful range of resistance values, a three gap spark plug device having external resistance connections was ignited in a pressurized nitrogen test cell by a conventional ignition system. Each gap of the spark plug was set at about 0.035 inches. The external resistance values were varied from about 180KΩ to 5.6 MΩ with good results achieved for all values of resistance. The applied voltage was sufficient to ignite the gaps in sequence and to maintain each gap broken down until all gaps break down. Thereafter the major portion of the ignition system energy was dissipated in all the gaps working together. The optimum values for a mass produced spark plug device will depend upon the number of spark gaps utilized, the length of the spark gaps, the electrical parameters of the associated ignition system and the anticipated pressure within the engine combustion chamber. The resistances R1, R2 and RN will be electrically in series with their associated gap immediately prior to gap breakdown and, once those gaps have been broken down, will be substantially an open circuit. For example, with gap G1 not broken down and gap G2 broken down, resistance R1 will be electrically in series with gap G2 and will be at a very high resistance value compared with gap G2 so that the potential applied to gap G1 will be substantially the full energizing potential applied between cap terminal 32 and housing 12 of the spark plug 10. Thus, by selecting values of resistance for resistors R1, R2 and RN-1 which will keep current drawn from the ignition system during the break down sequence to a low value, for example in the fractional milliampere ranges, all of the gaps may be broken down by an applied voltage substantially equal to that voltage necessary to break down a single gap. The resistances R1, R2 and RN-1 therefore will not dissipate any substantial quantities of the applied energy but will nevertheless electrically couple the intermediate electrodes to an electrical voltage potential which is related to the voltage applied to the spark plug terminal and which is stable during the time period of interest, that is, during generation of a spark by the spark plug device 10.

It will also be appreciated that other electrical arrangements for providing high resistance coupling between the intermediate electrodes and a stable or constant level of voltage are conceivable. For example, the resistances could be located externally of the spark plug device. Furthermore, each of the intermediate electrodes could be resistively connected to the grounded electrode 28 or spark plug housing 12. This form of resistive coupling would operate under the same constraints, that is, the value of resistances provided in the high resistance connection should be large enough to minimize power dissipation while being small enough to avoid the capacitive voltage divider effect. The arrangement of the resistance means within the ceramic material 16 of the spark generating means 10 eliminates the introduction or addition of any critical dimensions or tolerances to those normally encountered in present spark plug devices and results in a spark plug device 10 which may be readily manufactured by existing techniques. Furthermore, the resulting spark plugs may have substantially the same external dimensions so that engine modifications may be avoided. The number of intermediate electrodes will be virtually independent of the size of the spark plug device 10 since electrical cross connection and interference problems will be minimized. It will be also appreciated that the number of intermediate electrodes may be as small as one and may be as large as space constraints permit in order to provide a generated spark having sufficient length to ignite the contemplated lean air/fuel ratio mixture It will be seen that the present invention readily accomplishes its stated objectives. By providing a spark plug device having a plurality of sequentially ignited or fired air gaps and which may be conveniently manufactured is provided. Such spark plugs need not require engine alterations and are capable of having a large number of intermediate electrodes without greatly altering the external size of the devices.

We claim:

1. A spark plug device for generating a spark within the combustion chamber of a combustion engine comprising in combustion:

a conductive housing means having a generally cylindrical configuration with a threaded portion on an end thereof adapted for attachment to the engine;

an insulting member disposed within said housing;

a first electrode member extending generally through said insulating member and insulated thereby from the housing means and adapted on one end for electrical communication with a source of electrical energy and adapted on another end for sparking;

a second electrode member extending from the threaded end portion of said housing means and arranged to provide a portion thereof, adapted for sparking, in confronting relation to the end of said central electrode adapted for sparking;

a third electrode means positioned intermediate said first and second electrode means cooperative with said first electrode member to define a first air gap and cooperative with said second electrode member to define a second air gap, said second air gap being generally colinear with said first air gap; and high resistance coupling means electrically conductively connected to said third electrode means arranged to provide a high resistance electrical connection between said third electrode means and the source of electrical energy whereby said first and second air gaps will break down electrically in sequence.

2. The spark plug device of claim 1 wherein said high resistance means comprise an electrical resistor means electrically interconnecting said third electrode means and said electrode member.

3. The spark plug device of claim 1 wherein said high resitance means comprise an electrical resistor means electrically interconnecting said third electrode means and said conductive housing means.

4. The spark plug device of claim 1 including further:

fourth electrode means positioned cooperative with said first and second electrode members and said third electrode means to define a plurality of substantially continuous air spark gaps; and second high resistance means connected to said fourth electrode means and arranged to provide an electrical high resistance circuit between said fourth electrode means and the source of electrical energy.

5. The spark plug device of claim 4 wherein said first and second high resistance means comprise electrical resistor means embedded within said insulating member and connected electrically in parallel between said third and fourth electrode means, respectively, and said central electrode member.

6. The spark plug device of claim 4 wherein said first and second high resistance means comprise electrical resistor means embedded within said insulating member and connected electrically in parallel between said third and fourth electrode means, respectively, and said conductive housing.

7. In a spark plug device of the type having a housing, a pair of electrodes with the free ends of the electrodes defining an air gap, the electrodes being arranged for electrical communication with a source of electrical energy and dielectric means arranged to maintain the electrodes in insulated space-apart relation, the improvement comprising in combination:

at least one intermediate electrode means positioned within said air gap operative to separate the air gap into a plurality of substantially colinear air gaps; and one high resistance electrical means for each intermediate electrode means electrically connected to a selected one of the at least one intermediate electrode means and providing electrical high resistance circuit communication between said selected intermediate electrode means and an electrically stable voltage whereby each air gap may be sequentially broken down to produce an electrical spark simultaneously sustainable across all the air gaps.

8. The spark plug device of claim 7 wherein each high resistance electrical means is an electrical resistor means embedded with the dielectric and which is electrically relatively insulated from a first of the pair of electrodes and electrically relatively coupled to the other of the pair of electrodes.

* * * * *